US008561816B2

(12) United States Patent
Martin et al.

(10) Patent No.: US 8,561,816 B2
(45) Date of Patent: Oct. 22, 2013

(54) LOOSE ITEM HOLDER

(75) Inventors: Erica Martin, Otsego, MN (US); Rebecca Pelant, Corcoran, MN (US); Tracie Kunz, Albertville, MN (US)

(73) Assignee: Target Brands, Inc., Minneapolis, MN (US)

( * ) Notice: Subject to any disclaimer, the term of this patent is extended or adjusted under 35 U.S.C. 154(b) by 181 days.

(21) Appl. No.: 13/118,030

(22) Filed: May 27, 2011

(65) Prior Publication Data

US 2012/0298550 A1 Nov. 29, 2012

(51) Int. Cl.
*B42F 17/02* (2006.01)
*B42F 17/08* (2006.01)

(52) U.S. Cl.
USPC ..... 211/50; 211/10; 211/73; 206/425

(58) Field of Classification Search
USPC ..... 211/50, 184, 45, 55, 52, 126.13, 10, 211/128.1, 11, 72, 73, 71.01, 183, 134, 211/119.003; 206/425, 767; 40/124.01, 40/124.06, 124.09, 124.17, 642.02, 124, 40/124.2, 124.4
See application file for complete search history.

(56) References Cited

U.S. PATENT DOCUMENTS

| | | | | | |
|---|---|---|---|---|---|
| 403,535 | A | * | 5/1889 | Johnson | 206/730 |
| 2,833,070 | A | | 5/1958 | Goldman | |
| 2,909,287 | A | * | 10/1959 | Galassi | 211/55 |
| 3,146,739 | A | * | 9/1964 | Murray | 109/52 |
| 3,567,014 | A | | 3/1971 | Feigelman | |
| 3,881,649 | A | | 5/1975 | Krautsack | |
| 4,079,841 | A | * | 3/1978 | Castel | 211/131.1 |
| D251,466 | S | | 4/1979 | Ciminelli | |
| 4,183,438 | A | * | 1/1980 | Huczek | 211/59.2 |
| D267,383 | S | * | 12/1982 | Liptak et al. | D6/470 |
| 4,460,095 | A | * | 7/1984 | Kessler et al. | 211/69.1 |
| 4,463,848 | A | * | 8/1984 | Parker | 206/214 |
| 4,630,731 | A | | 12/1986 | Albery | |
| 4,756,409 | A | | 7/1988 | Murray | |
| 4,828,121 | A | | 5/1989 | Willcocks, Jr. | |
| 4,858,774 | A | * | 8/1989 | Winter et al. | 211/184 |
| 4,871,218 | A | * | 10/1989 | Swinson | 312/312 |
| 4,901,883 | A | * | 2/1990 | Hoffman | 220/830 |
| D308,784 | S | | 6/1990 | Liptak | |
| 4,947,996 | A | | 8/1990 | Harris | |
| D321,446 | S | | 11/1991 | Liptak | |
| 5,085,328 | A | * | 2/1992 | Evenson | 211/55 |
| 5,094,349 | A | * | 3/1992 | DeVito | 211/50 |
| 5,150,813 | A | * | 9/1992 | Harris et al. | 220/480 |
| D330,474 | S | | 10/1992 | Liptak | |
| 5,249,669 | A | * | 10/1993 | Resnick et al. | 206/740 |
| 5,301,800 | A | | 4/1994 | Kenney | |

(Continued)

OTHER PUBLICATIONS

Photos showing U.S. public use of prior art holders, first public use prior to May 1, 2010.

*Primary Examiner* — Jennifer E Novosad
(74) *Attorney, Agent, or Firm* — Theodore M. Magee; Westman, Champlin & Kelly, P.A.

(57) ABSTRACT

A retail display apparatus includes a front panel, a right side panel extending from the front panel and a left side panel extending from the front panel. A bottom panel extends from the front panel and has at least one opening. A back panel extends from the bottom panel. A first channel has an open top and an open bottom and extends along the back panel. A second channel has an open top and an open bottom and extends along the back panel.

17 Claims, 12 Drawing Sheets

(56) References Cited

U.S. PATENT DOCUMENTS

| | | | | | |
|---|---|---|---|---|---|
| 5,370,223 | A | | 12/1994 | Leicht, Jr. | |
| D366,907 | S | * | 2/1996 | Taylor | D19/90 |
| 5,542,551 | A | * | 8/1996 | Smith | 211/50 |
| 5,641,074 | A | * | 6/1997 | Smed | 211/11 |
| 5,657,880 | A | * | 8/1997 | Birnbaum | 211/50 |
| 5,755,337 | A | * | 5/1998 | Linn | 211/13.1 |
| 5,800,027 | A | | 9/1998 | Dunn | |
| 5,803,275 | A | | 9/1998 | Schweitzer | |
| D410,495 | S | | 6/1999 | Wear | |
| D410,686 | S | | 6/1999 | Wear | |
| 6,206,225 | B1 | * | 3/2001 | Fox | 220/501 |
| 6,431,364 | B1 | | 8/2002 | Saladyga | |
| 6,454,106 | B1 | * | 9/2002 | Howard | 211/50 |
| 6,591,522 | B2 | * | 7/2003 | Doss | 40/122 |
| 6,651,827 | B1 | | 11/2003 | Eberwein et al. | |
| 6,681,510 | B1 | | 1/2004 | Salatin et al. | |
| 6,968,959 | B1 | | 11/2005 | Garvin | |
| 7,086,559 | B2 | | 8/2006 | Poole, Jr. | |
| 7,909,182 | B2 | * | 3/2011 | Maier-Hunke | 211/55 |
| 2008/0128319 | A1 | * | 6/2008 | Noble Colin et al. | 206/745 |

* cited by examiner

LOOSE ITEM HOLDER

BACKGROUND

In retail environments, products that are to be purchased are generally placed directly on the shelves so that a guest can place the products in their cart or basket and take them to a checkout counter for purchase. However, in some locations, regulations require retailers to obtain identifying information about a guest before giving the guest access to certain products. For example, in some locations, products containing ephedrine must be kept behind a counter and can only be given to the guest after the guest furnishes an identification card.

To accommodate these regulations, retailers removed ephedrine-containing products from their shelves and put a card holder in place of the products. Each card holder includes a stack of cards that depicts the product that has been removed and instructs the guest to take the card to a pharmacy counter to obtain the desired product.

This card holder technique has also been used for some products that are kept behind the pharmacy counter to reduce theft of the items. The cards let guests know that the retailer has the item and how to purchase the item while reducing the likelihood that the item will be stolen.

The discussion above is merely provided for general background information and is not intended to be used as an aid in determining the scope of the claimed subject matter.

SUMMARY

A retail display apparatus includes a front panel, a right side panel extending from the front panel and a left side panel extending from the front panel. A bottom panel extends from the front panel and has at least one opening. A back panel extends from the bottom panel. A first channel has an open top and an open bottom and extends along the back panel. A second channel has an open top and an open bottom and extends along the back panel.

A retail display unit includes a shelf having multiple openings along a line and a plurality of loose item holders. Each loose item holder has a bottom with at least one opening that overlaps an opening in the shelf and has a back with two channels. A plurality of printed sheets is provided, with one printed sheet for each holder. Each printed sheet is positioned within two channels of a respective holder. Text from each printed sheet can be viewed through the back of each respective holder.

A method of displaying loose items includes mounting a holder to a shelf by passing fasteners through holes in the holder and holes in the shelf. A card is inserted into the tops of two channels on a back of the holder and the card is moved downward through the two channels until a bottom of the card rests on the shelf. The holder is then filled with loose items.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
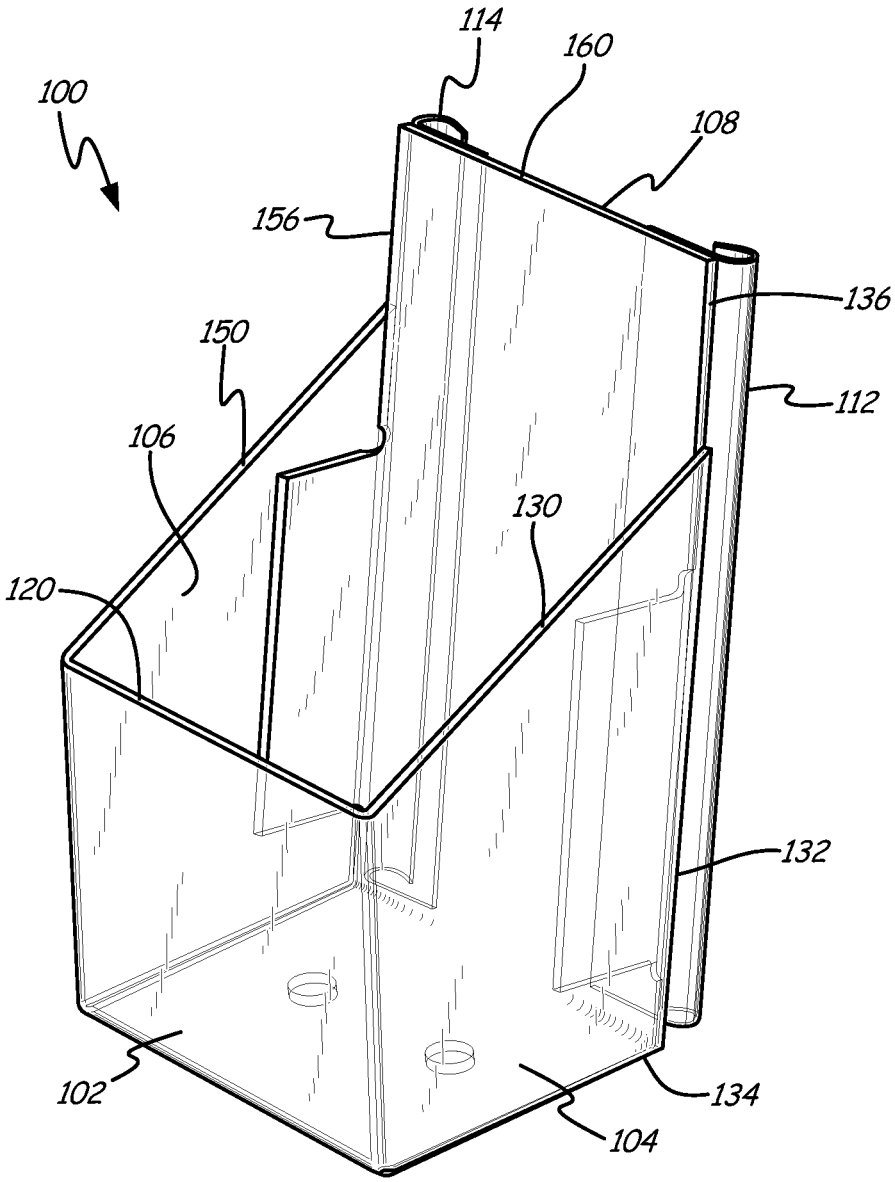
FIG. 1 is a front perspective view of a printed material holder.

Current card holders for retail shelving are less than optimal because they do not easily attach to the shelves, they waste horizontal shelving space, and it is difficult to place a representative card in the back of the card holder.

The present inventors have created a printed material holder for shelving that includes two openings allowing the holder to be attached directly to the shelf. Further, the openings and the width of the holder are designed such that multiple holders may be mounted side-by-side on a shelf without wasting shelf space between the holders.

In accordance with one embodiment, a holder is mounted to a shelf by passing fasteners through openings in the holder and openings in the shelf. In some embodiments, mounting a holder comprises mounting the holder such that a front section of the holder extends upward from a front edge of the shelf.

A card is inserted into the tops of two channels on a back of the holder and the card is moved downward through the two channels until a bottom of the card rests on the shelf. In some embodiments, the card is inserted into the tops of two channels that are adhered to the back of the holder and that are separated by a distance over which the back of the holder is exposed, where the back of the holder is a single layer of material. In the area where the back of the holder is exposed, light only has to pass through the single layer of the back of the holder to reach the card held in the channels. The holder is filled with loose items such as printed material.

In accordance with further embodiments, a plurality of holders are mounted to the shelf by passing fasteners through holes in each holder and holes in the shelf such that each of the plurality of holders is within a quarter inch of at least one other holder. In such a configuration, a card is removed from two channels of a holder without removing any holders from the shelf, where the holder that the card is removed from is within a quarter inch of neighboring holders on two opposing sides of the holder.

FIGS. 1-8 provide a front perspective view, a rear perspective view, a front view, a rear view, a right side view, a left side view, a top view and a bottom view, respectively, of a loose item holder 100, which forms all or part of a retail display apparatus also referred to as a retail display unit.

Loose item holder 100 has a front panel or section 102, a right side panel or section 104, a left side panel or section 106, a back panel or section 108, a bottom panel or section 110 (shown in FIG. 8), a right or first channel 112 and a left or second channel 114.

Front panel 102 is continuous with and extends from right side panel 104, left side panel 106, and bottom panel 110. Front panel 102 includes a horizontal top edge 120 that in accordance with some embodiments is substantially parallel to bottom panel 110. In accordance with one embodiment, front panel 102 has a width 122 (shown in FIG. 3) from right side panel 104 to left side panel 106 of approximately 2.40 inches (6.1 cm) and has a height 124 from bottom panel 110 to top edge 120 of approximately 2.05 inches (5.2 cm).

Figure 5:
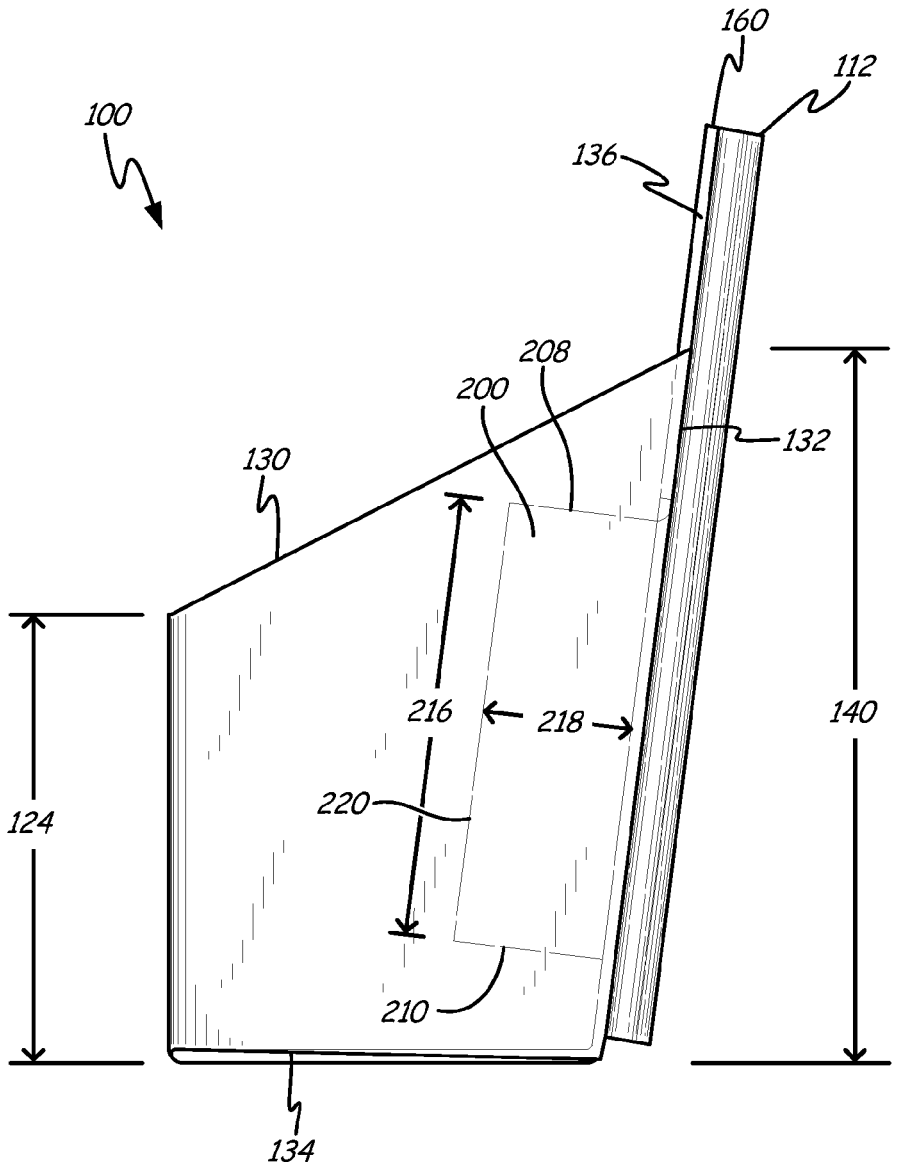
FIG. 5 is a right side view of the printed material holder of FIG. 1.
Figure 8:
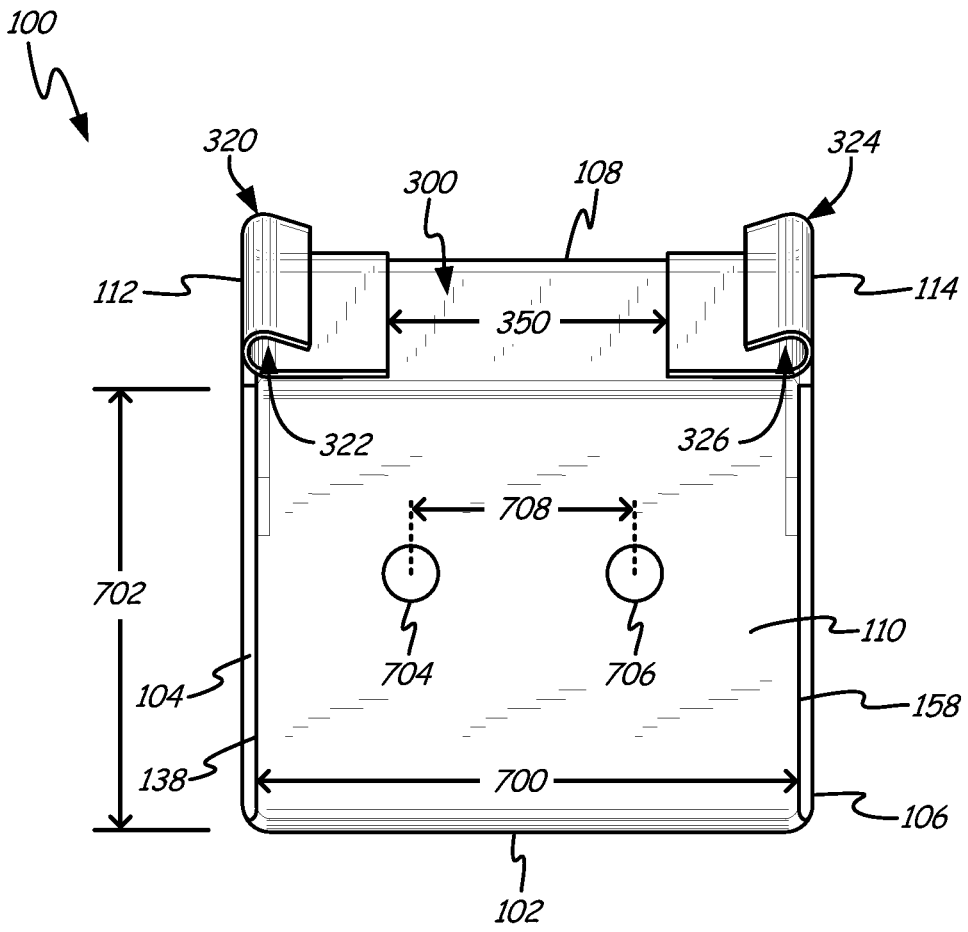
FIG. 8 is a bottom view of the printed material holder of FIG. 1.

In accordance with one embodiment, right side panel 104 is continuous with and extends from front panel 102. As shown in FIG. 5, right side panel 104 has an angled top edge 130, an angled free side edge 132 and a free bottom edge 134. Right side panel 104 abuts a free side edge 136 of back panel 108 such that angled free side edge 132 is parallel to back panel 108, which in accordance with one embodiment is at an angle of approximately 95 degrees to bottom panel 110. Right side panel 104 also abuts a free side edge 138 of bottom panel 110 (FIG. 8). Angled top edge 130 begins at height 124 at the juncture with front panel 102 and extends upward to a height 140 above bottom panel 110. In one embodiment, height 140 is approximately 3.27 inches (8.3 cm).

Figure 6:
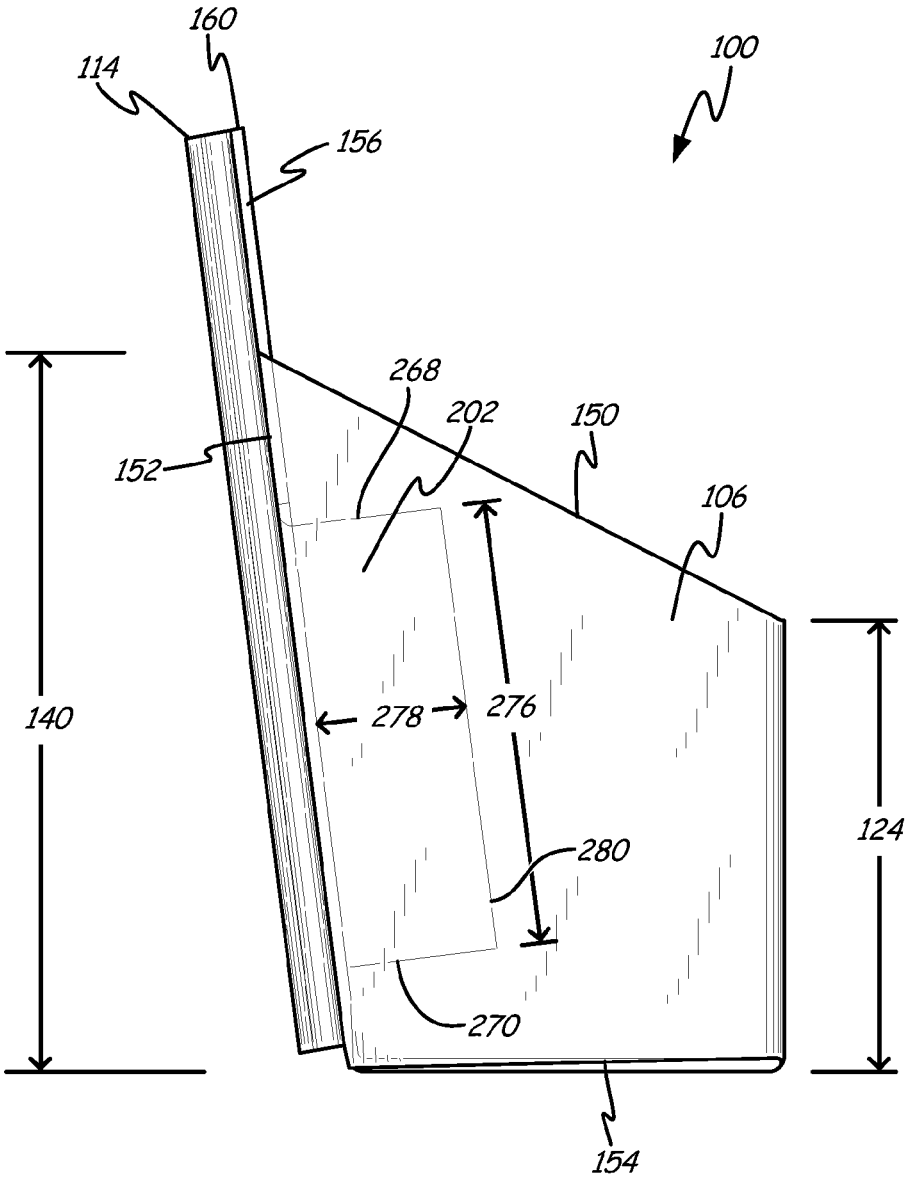
FIG. 6 is a left side view of the printed material holder of FIG. 1.
Figure 7:
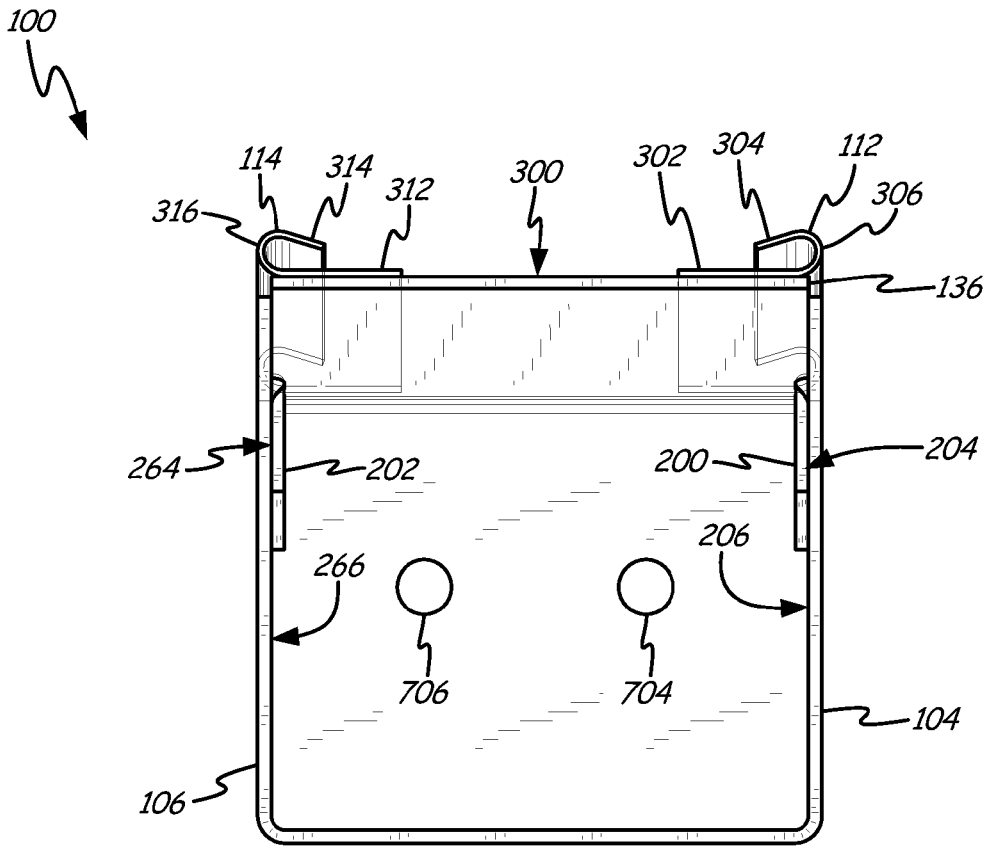
FIG. 7 is a top view of the printed material holder of FIG. 1.

In accordance with one embodiment, left side panel 106 is continuous with and extends from front panel 102. As shown in FIG. 6, left side panel 106 has an angled top edge 150, an angled free side edge 152 and a free bottom edge 154. Left side panel 106 abuts a free side edge 156 of back panel 108 such that angled free side edge 152 is parallel to back panel 108. Left side panel 106 also abuts a free side edge 158 of bottom panel 110 (FIG. 8). Angled top edge 150 begins at height 124 at the juncture with front panel 102 and extends upward to height 140 above bottom panel 110.

In accordance with one embodiment, back panel 108 is continuous with and extends from bottom panel 110. In addition to free side edges 136 and 156, back panel 108 has a free top edge 160 that is parallel to bottom panel 110. Free top edge 160 is a height 162 (shown in FIG. 4) above bottom panel 110.

Figure 2:
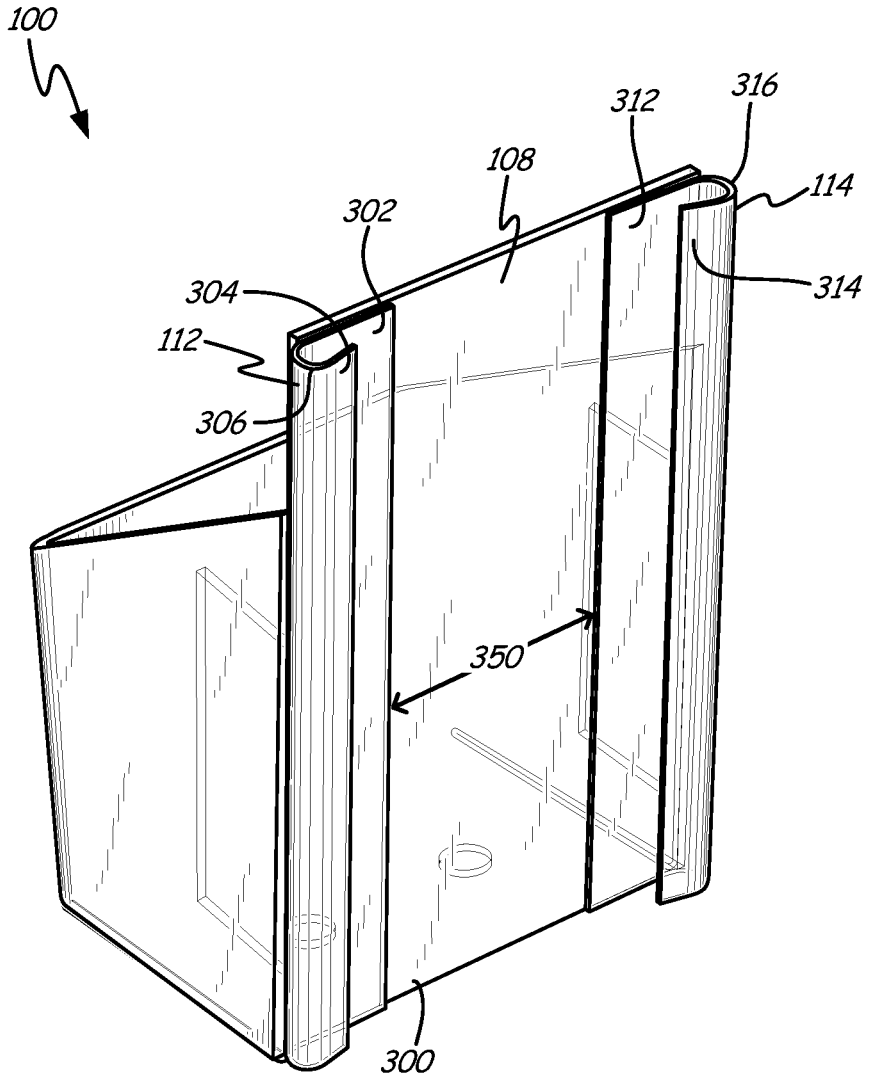
FIG. 2 is a back perspective view of the printed material holder of FIG. 1.
Figure 3:
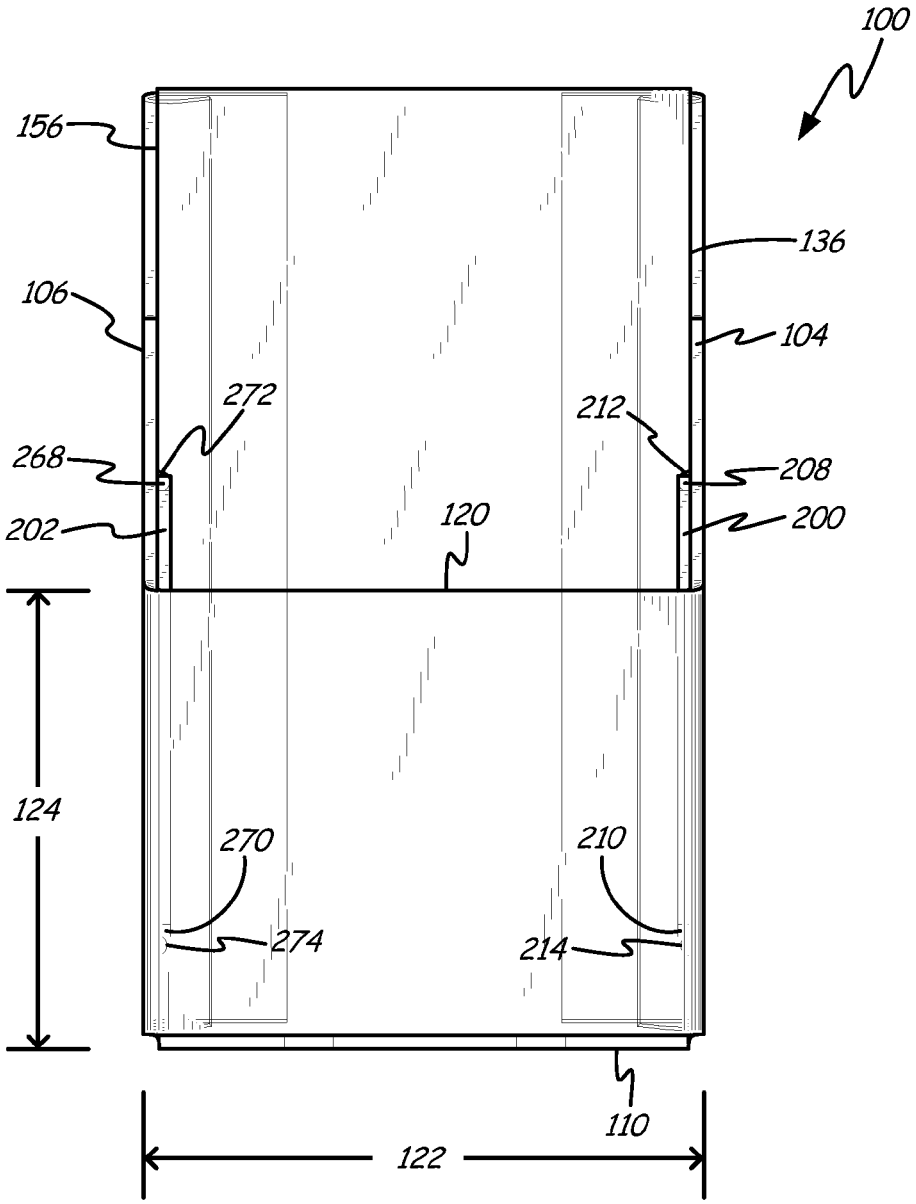
FIG. 3 is a front view of the printed material holder of FIG. 1.
Figure 4:
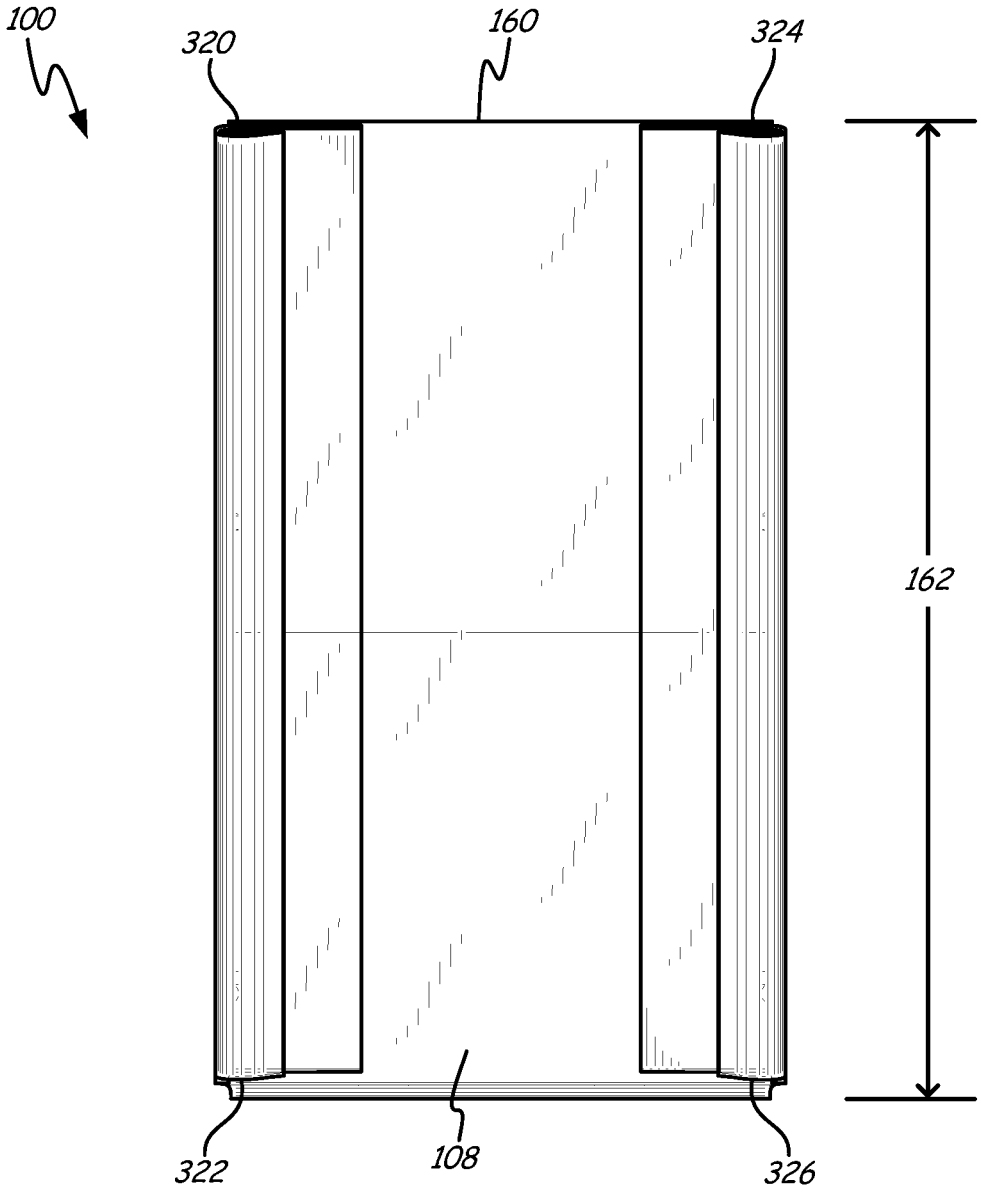
FIG. 4 is a back view of the printed material holder of FIG. 1.

Right channel 112 extends along an outer surface 300 of back panel 108 parallel to free edge 136 of back panel 108 between top edge 160 and bottom panel 110. In accordance with some embodiments, right channel 112 is molded as a single piece with back panel 108 and in accordance with other embodiments, right channel 112 is attached, mounted, bonded or adhered to outer surface 300 of back panel 108. As shown in FIG. 2, right channel 112 includes an inner wall 302 that is attached to outer surface 300, an outer wall 304 and a curved wall 306 that extends between inner wall 302 and outer wall 304. Inner wall 302, outer wall 304 and curved wall 306 extend from an open top 320 of right channel 112 to an open bottom 322 of right channel 112. (FIGS. 4 and 8) Open top 320 is such that a card may be inserted into the space between inner wall 302 and outer wall 304 at open top 320 in a direction toward open bottom 322 and pass through open bottom 322. In accordance with one embodiment, inner wall 302 is adhered to outer surface 300 by an adhesive such as an adhesive tape.

Left channel 114 extends along outer surface 300 of back panel 108 parallel to free edge 156 of back panel 108 between top edge 160 and bottom panel 110. In accordance with some embodiments, left channel 114 is molded as a single piece with back panel 108 and in accordance with other embodiments, left channel 114 is attached, mounted, bonded or adhered to outer surface 300 of back panel 108. As shown in FIG. 2, left channel 114 includes an inner wall 312 that is attached to outer surface 300, an outer wall 314 and a curved wall 316 that extends between inner wall 312 and outer wall 314. Inner wall 312, outer wall 314 and curved wall 316 extend from an open top 324 of left channel 114 to an open bottom 326 of left channel 114. (FIGS. 4 and 8) Open top 324 is such that a card may be inserted into the space between inner wall 312 and outer wall 314 at open top 324 in a direction toward open bottom 326 and pass through open bottom 326. In accordance with one embodiment, inner wall 312 is adhered to outer surface 300 by an adhesive such as an adhesive tape.

In accordance with one embodiment, inner wall 302 of right channel 112 and inner wall 312 of left channel 114 are not continuous with each other. Instead, inner wall 302 is separated from inner wall 312 by a distance 350 (FIG. 2) over which a surface of back panel 108 is exposed. In the space between right channel 112 and left channel 114 represented by distance 350, light only has to pass through the single layer of back panel 108 to reach a display card held by right channel 112 and left channel 114. If right channel 112 and left channel 114 were formed of a continuous material that occupied the distance 350, light would have to pass through more material in order to reach the display card, which would reduce the clarity of the card.

A right tab 200 and a left tab 202 are continuous with and extend from back panel 108. Right tab 200 is out of plane from or at an angle to back panel 108 so that it is parallel to right side panel 104. (FIG. 7) A surface 204 of right tab 200 is connected to an interior surface 206 of right side panel 104. (FIG. 7) In accordance with one embodiment, surface 204 of right tab 200 is adhered to interior surface 206 by an adhesive layer or an adhesive tape. In other embodiments, surface 204 is sonically welded to interior surface 206. Right tab 200 has a top edge 208 and a bottom edge 210. (FIG. 5) In accordance with one embodiment, top edge 208 extends along the top of right tab 200 and into a bottom edge of a notch 212 in back panel 108. (FIG. 3) Similarly, bottom edge 210 extends along the bottom of right tab 200 and into a top edge of a notch 214 in back panel 108. (FIG. 3) Notches 212 and 214 allow right tab 200 to be bent relative to back panel 108 so that right tab 200 is parallel to and abutting against interior surface 206 of right side panel 104. In accordance with one embodiment, right tab 200 has a height 216 (FIG. 5) from bottom edge 210 to top edge 208 of approximately 2.01 inches (5.1 cm), and a width 218 from back panel 108 to a free edge 220 of approximately 0.67 inches (1.7 cm).

Left tab 202 is out of plane from or at an angle to back panel 108 so that it is parallel to left side panel 106. (FIG. 7) A surface 264 of left tab 202 is connected to an interior surface 266 of left side panel 106. (FIG. 7) In accordance with one embodiment, surface 264 of left tab 202 is adhered to interior surface 266 by an adhesive layer or adhesive tape. In other embodiments, surface 264 is sonically welded to interior surface 266. Left tab 202 has a top edge 268 and a bottom edge 270. (FIG. 6) In accordance with one embodiment, top edge 268 extends along the top of left tab 202 and into a bottom edge of a notch 272 in back panel 108. Similarly, bottom edge 270 extends along the bottom of left tab 202 and into a top edge of a notch 274 in back panel 108. Notches 272 and 274 allow left tab 202 to be bent relative to back panel 108 so that left tab 202 is parallel to and abutting against interior surface 266 of left side panel 106. In accordance with one embodiment left tab 202 has a height 276 (FIG. 6) from bottom edge 270 to top edge 268 of approximately 2.01

INCHES (5.1 cm), and a width 278 from back panel 108 to a free edge 280 of approximately 0.67 inches (1.7 cm).

As shown in FIG. 8, bottom panel 110 is continuous with and extends from front panel 102 and back panel 108 in accordance with one embodiment. Bottom panel has two free side edges 138 and 158, with free side edge 138 extending between front panel 102 and back panel 108 next to right side panel 104 and free side edge 158 extending between front panel 102 and back panel 108 next to left side panel 106. In accordance with one embodiment, bottom panel 110 has a width 700 from free side edge 138 to free side edge 158 of approximately 2.32 inches (5.9 cm) and a length 702 from front panel 102 to back panel 108 of approximately 1.81 inches (4.6 cm).

Bottom panel 110 includes two openings or holes 704 and 706. In accordance with one embodiment, openings 704 and 706 are circular openings that have a diameter of approximately 0.25 inches (0.6 cm) and their centers are separated by a distance 708 of approximately 1.00 inches (2.5 cm). Although circular openings are shown in FIG. 8, openings or holes 704 and 706 may have other shapes such as polygonal shapes or rounded slot shapes, for example. Openings or holes 704 and 706 are provided to receive fasteners to secure holder 100 to a retail shelf. Although two openings are shown in FIG. 8, other embodiments will have a single opening and still further embodiments will have more than two openings.

In accordance with one embodiment, back panel 108, right channel 112 and left channel 114 are made of clear material(s) such that a display card inserted in both right channel 112 and left channel 114 can be viewed through back panel 108, right channel 112 and left channel 114. In accordance with some embodiments, the entirety of holder 100 is made of clear material(s). In accordance with one embodiment, holder 100 is made of clear plastic(s).

In accordance with one embodiment, front panel 102, right side panel 104, left side panel 106, back panel 108, bottom panel 110, right tab 200 and left tab 202 are made of a single sheet of material that has been bent to provide the shape of holder 100. In accordance with one embodiment, the single sheet of material is a plastic material that is bent via the selective application of sufficient heat while applying force to different portions of the plastic material to form the elements of holder 100.

Figure 9:
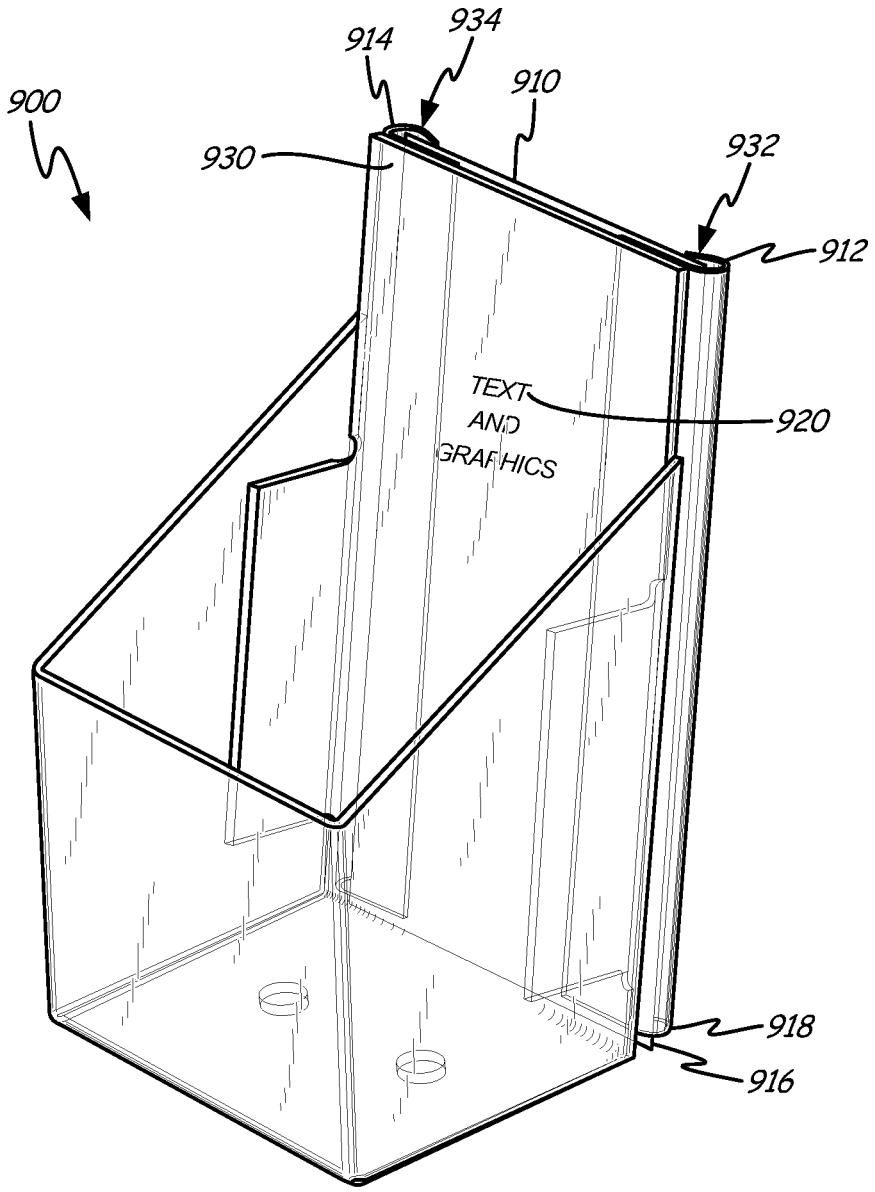
FIG. 9 is a front perspective view of the printed material holder of FIG. 1 showing a card held in channels on the back of the printed material holder.

FIG. 9 shows a perspective view of a printed material holder 900 having a display card 910 mounted in channels 912 and 914. In FIG. 9, a bottom 916 of display card 910 passes through the bottom 918 of channel 912 and the bottom of channel 914. Bottom 916 of display card 910 is designed to be supported by a shelf to which holder 900 is mounted. Text and/or graphics 920 on display card 910 is/are visible through back panel 930 of holder 900. The tops 932 and 934 of channels 912 and 914 are open such that display card 910 can be inserted from the top of holder 900. This allows display card 910 in holder 900 to be changed without having to gain access to the side of holder 900.

Figure 10:
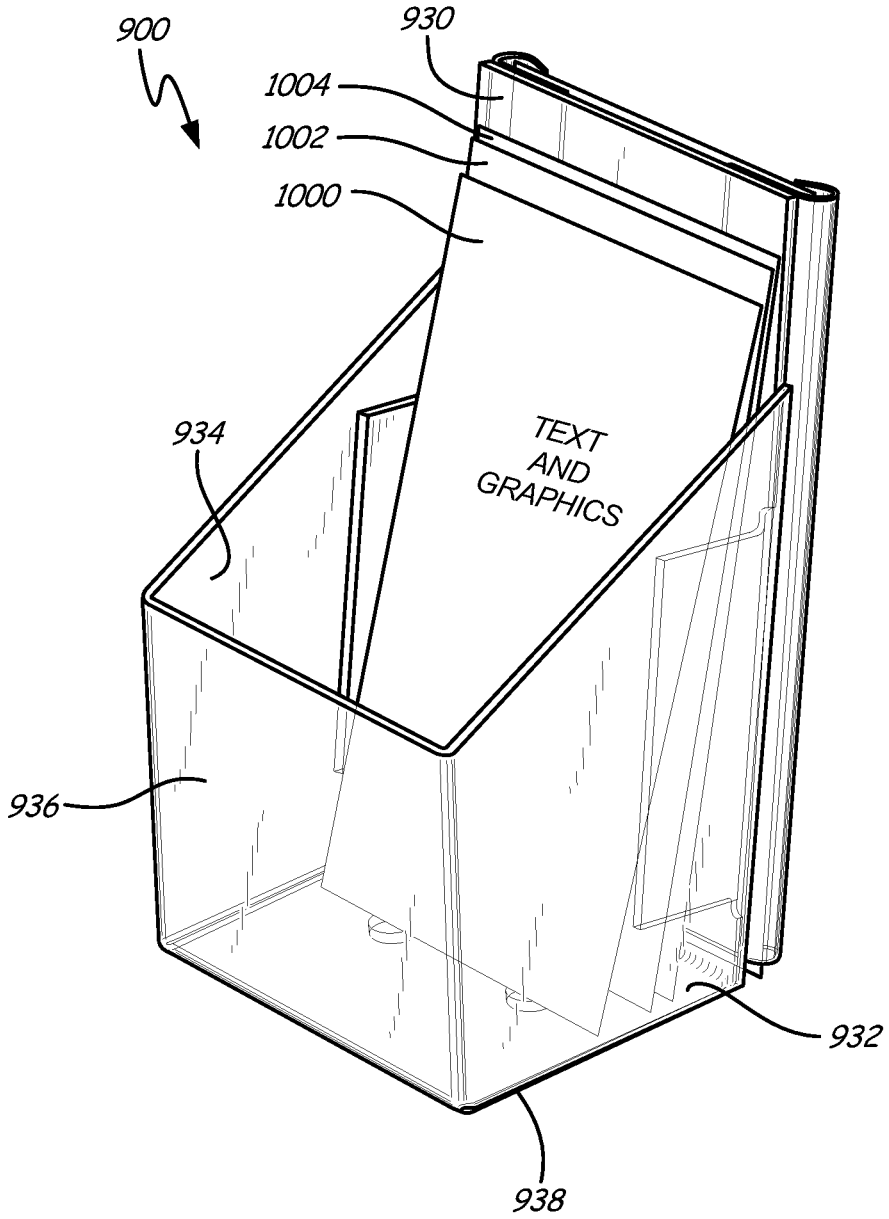
FIG. 10 is a front perspective view of the printed material holder of FIG. 9 further showing loose cards in the holder.

FIG. 10 is a perspective view of holder 900 of FIG. 9 with loose cards 1000, 1002 and 1004 placed in the interior of holder 900, where the interior is defined by back panel 930, right side panel 932, left side panel 934, front panel 936 and bottom panel 938.

Figure 11:
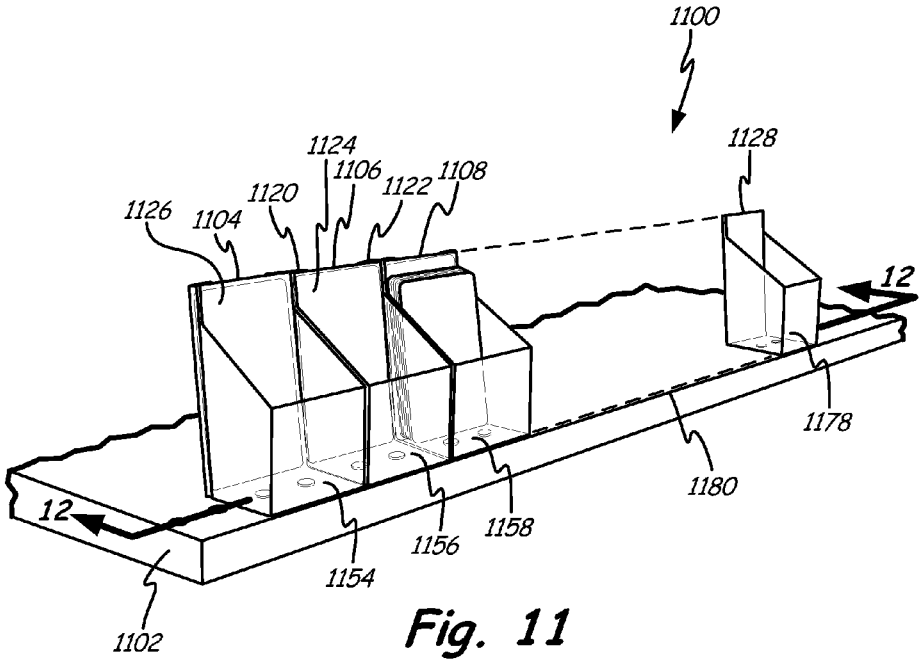
FIG. 11 is a perspective view of a row of holders on a shelf.

FIG. 11 is a perspective view of a row 1100 of loose item holders mounted to a shelf 1102, where row 1100 of the loose item holders forms a display apparatus. In some embodiments, row 1100 of loose item holders and shelf 1102 together form a display apparatus. The row of holders 1100 includes holders 1104, 1106, 1108, and 1128 with the dotted lines between holder 1108 and 1128 representing any desired number of additional holders that are not shown but have the same shape and size as holders 1104, 1106, 1108 and 1128. Holders 1104, 1106, 1108 and 1128 may be referred to relative to each other by designating one holder as a first holder and another holder as a second holder. Each of the holders in row 1100 is substantially similar to holder 100 described above with respect to FIGS. 1-8. Thus, each of the holders has a back panel with two channels extending from the top to the bottom of the back panel, where the channels are separated by a distance such that a portion of the back panel is exposed between the two channels. Each holder further has a bottom panel or section with two openings that align or overlap with openings in the shelf. The holders of row 1100 are mounted on shelf 1102 such that there is very little to no horizontal space between adjacent holders on the shelf. Thus, in accordance with some embodiments, holder 1106 is in direct contact with holder 1104 on one side and in direct contact with holder 1108 on the other side. In other embodiments, holder 1106 is not in direct contact with holder 1104 and 1108 but is separated from holder 1104 by less than a quarter of an inch and is separated from holder 1108 by less than a quarter of an inch. In the arrangement shown in FIG. 11, the ability to insert display cards in the channels is made possible by having the tops of the channels open. Thus, in holder 1106, the tops of channels 1120 and 1122 are open thereby allowing display card 1124 to be removed and replaced with another card without requiring any of the holders to be removed from shelf 1102.

Each of the holders in the row of holders 1100 contains a display card or printed sheet between two channels mounted on the back of the holder as shown in FIG. 9. Each of the display cards or printed sheets extends through open bottoms of the respective channels so that the bottom of each of the display cards/printed sheets rests on shelf 1102. For example, holder 1104 has printed sheet 1126 within the two channels on the back of holder 1104 and holder 1106 has printed sheet 1124 within channels 1120 and 1122 on the back of holder 1106. Text and graphics on the printed sheets or display cards held within the channels on the back of the holders can be viewed through the back of each respective holder because the back of the holder is transparent. Thus, standing in front of the holder, the text and graphics on the printed sheets held in the channels can be viewed.

In FIG. 11, the holders 1104, 1106, 1108, and 1128 are mounted to shelf 1102 such that front panels or sections 1154, 1156, 1158, and 1178 extend upward from a front edge 1180 of shelf 1102.

Figure 12:
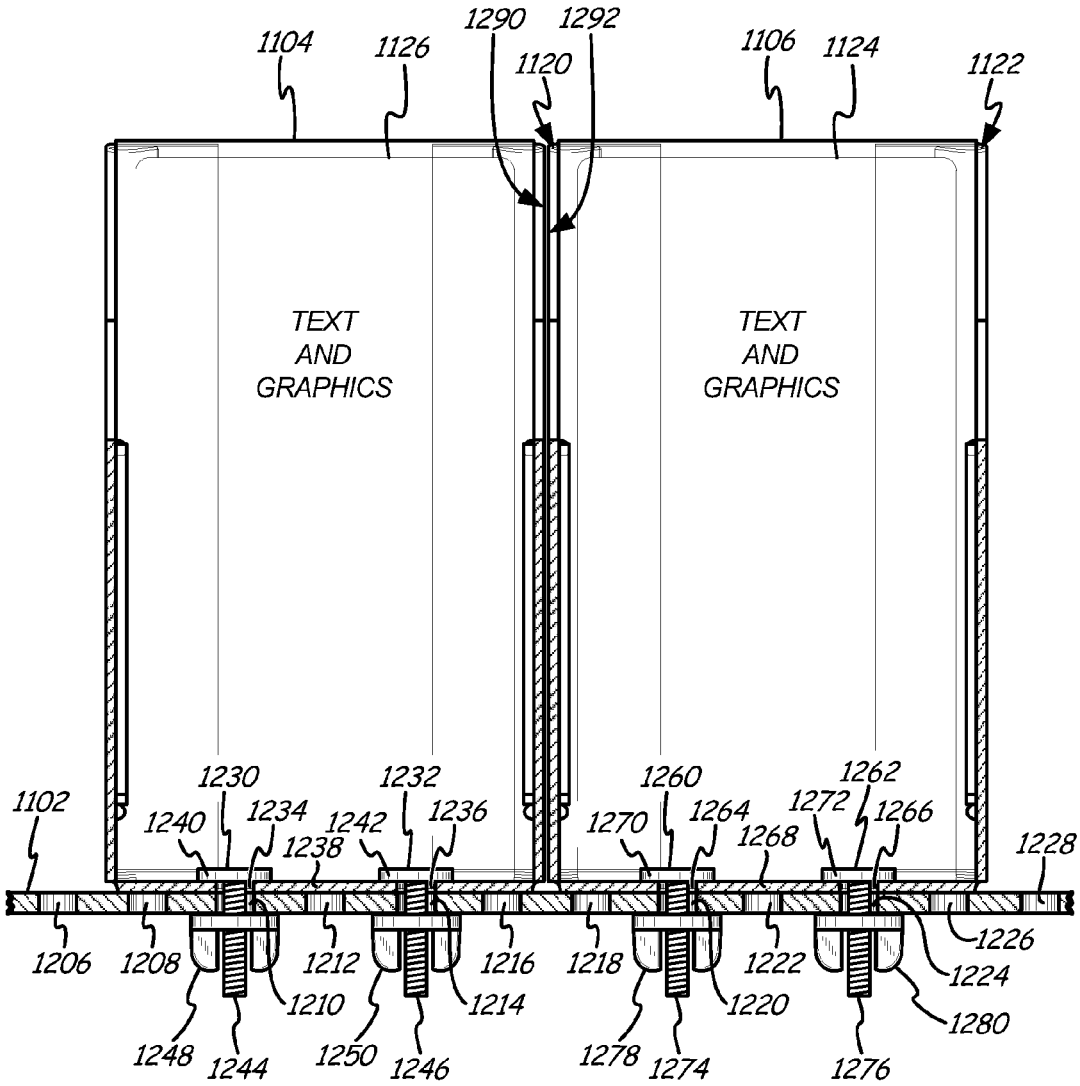
FIG. 12 is a cross-sectional view of two printed material holders mounted to a shelf.

FIG. 12 provides a cross-sectional view of printed-material holders 1104 and 1106 mounted to shelf 1102. In FIG. 12, shelf 1102 is shown to have evenly spaced openings or holes 1206, 1208, 1210, 1212, 1214, 1216, 1218, 1220, 1222, 1224, 1226, and 1228 that are aligned along a straight line.

Holder 1104 is mounted to shelf 1102 by two fasteners 1230 and 1232 passing through openings 1234 and 1236, respectively, in bottom panel 1238 of holder 1104 as well as openings 1210 and 1214, respectively, of shelf 1102. Openings 1234 and 1236 are aligned with or overlap openings 1210 and 1214, respectively. In accordance with one embodiment, fasteners 1230 and 1232 include heads 1240 and 1242, respectively, ribbed shafts 1244 and 1246, respectively, and nuts 1248 and 1250, respectively. In some embodiments, ribbed shafts 1244 and 1246 are pressed into nuts 1248 and 1250 to place the fasteners in a locking configuration and thereby mount the holder to the shelf. In other embodiments, shafts 1244 and 1246 are threaded and are screwed into nuts 1248 and 1250 to place the fasteners in a locking configuration and thereby mount the holder to the shelf. Holder 1106 is mounted to shelf 1102 by two fasteners 1260 and 1262 passing through openings 1264 and 1266, respectively, in bottom panel 1268 of holder 1106 as well as openings 1220 and 1224, respectively, of shelf 1102. In accordance with one embodiment, fasteners 1260 and 1262 include heads 1270 and 1272, respectively, ribbed shafts 1274 and 1276, respectively, and nuts 1278 and 1280, respectively. In some embodiments, ribbed shafts 1274 and 1276 are pressed into nuts 1278 and 1280 to place the fasteners in a locking configuration and thereby mount the holder to the shelf. In other embodiments, shafts 1274 and 1276 are threaded and are screwed into nuts 1278 and 1280 to place the fasteners in a locking configuration and thereby mount the holder to the shelf.

In FIG. 12, the positions of openings 1234 and 1236 in holder 1104 and the positions of openings 1264 and 1266 in holder 1106 allow holders 1104 and 1106 to be mounted on shelf 1102 such that side surface 1290 of holder 1104 is within a quarter inch of, and in some embodiments in direct contact with, side surface 1292 of holder 1106. This makes efficient use of shelf space by eliminating wasted space between holders 1104 and 1106.

The holders described above provide for methods of displaying loose items. One such method includes mounting a holder to a shelf by passing fasteners through holes in the holder and holes in the shelf. A card is inserted into the tops of two channels on a back of the holder and separated by a distance over which the back of the holder is exposed. In accordance with some embodiments, the back is a single layer of material. The card is moved downward through the two channels until a bottom of the card rests on the shelf. The holder can then be filled with loose items.

In a further method, multiple holders are mounted to the shelf such that each holder is less than a quarter inch from at least one other holder on the shelf and each holder has a front panel that extends upward from a front edge of the shelf. In further methods, a card is removed from two channels of a holder without removing any holders from the shelf, where the holder that the card is removed from is within a quarter inch of neighboring holders on two opposing sides of the holder. For example, card 1124 is removed from channels 1120 and 1122 of holder 1106 without removing any of holders 1104, 1106, or 1108, where holders 1104 and 1108 are neighboring holders of holder 1106 on two opposing sides (one side next to holder 1104 and the other side next to holder 1108) and are within a quarter inch of holder 1106.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A retail display apparatus comprising:

a single sheet of material bent to form a holder comprising:

a front panel, a right side panel and a left side panel both extending from the front panel;

a bottom panel extending from the front panel and having at least one opening; and a back panel extending from the bottom panel;

a first clear channel separately attached to the single sheet of material having an open top and an open bottom and a clear inner wall attached to and extending along the back panel of the holder; and a second clear channel separately attached to the single sheet of material having an open top and an open bottom and a clear inner wall attached to and extending along the back panel of the holder.

2. The display apparatus of claim 1 wherein the first clear channel and the second clear channel are separated by a distance over which the back panel is exposed.

3. The display apparatus of claim 1 further comprising a display card inserted in the first clear channel and the second clear channel such that light can reach the display card by passing through only the back panel.

4. The display apparatus of claim 1 further comprising a shelf, wherein the bottom panel is attached to the shelf by at least one fastener passing through the at least one respective opening in the bottom panel and at least one respective opening in the shelf.

5. The display apparatus of claim 4 wherein each fastener is placed in a locking configuration by pushing the fastener through a respective opening in the bottom panel, through a respective opening in the shelf and into a respective nut.

6. The display apparatus of claim 4 wherein the display apparatus further comprises:

a single sheet of material bent into a second holder comprising:

a second holder front panel, a second holder right side panel and a second holder left side panel extending from the second holder front panel;

a second holder bottom panel extending from the second holder front panel and having at least one opening; and a second holder back panel extending from the second holder bottom panel;

at least one second holder fastener passing through at least one respective opening in the second holder bottom panel and through at least one respective opening in the shelf;

a second holder first channel having an open top and an open bottom and extending along the second holder back panel; and a second holder second channel having an open top and an open bottom and extending along the second holder back panel.

7. The display apparatus of claim 6 wherein the first holder is mounted on the shelf within a quarter inch of the second holder.

8. A retail display unit comprising:

a shelf having multiple openings along a line;

a plurality of loose item holders, each loose item holder comprising:

a bottom panel with at least one opening that overlaps an opening in the shelf;

a back with two channels, each channel having an open top and an open bottom;

a right side panel, a left side panel, a right tab and a left tab, wherein the right tab extends from and is continuous with the back, is parallel to and attached to the right side panel and is at an angle to the back and wherein the left tab extends from and is continuous with the back, is parallel to the left side panel and attached to the left side panel and is at an angle to the back; and a plurality of printed sheets, with one printed sheet for each holder, wherein each printed sheet is positioned within the two channels of its respective holder such that text from each printed sheet can be viewed through the back of each respective loose item holder.

9. The retail display unit of claim 8 further comprising at least one fastener for each holder, wherein each fastener passes through an opening in its respective holder and an opening in the shelf to mount the respective holder to the shelf.

10. The retail display unit of claim 8 wherein the two channels on each respective loose item holder are separated by a distance such that a surface of the back is exposed between the two channels.

11. The retail display unit of claim 10 wherein each of the plurality of loose item holders is mounted to the shelf within a quarter inch of at least one other of the plurality of loose item holders.

12. The retail display unit of claim 8 wherein each of the printed sheets has a bottom that rests on the shelf.

13. A method of displaying loose items, the method comprising:

mounting a holder to a shelf by passing fasteners through holes in the holder and holes in the shelf, the holder comprising a clear front, a clear right side extending from the clear front, a clear left side extending from the clear front, a clear bottom extending from the clear front wherein the holes in the holder are in the clear bottom, and a clear back extending from the clear bottom;

inserting a card into the tops of two channels on the clear back of the holder and moving the card downward through the two channels until a bottom of the card rests on the shelf each channel comprising a respective clear inner wall attached to an outer surface of the clear back of the holder such that the card may be viewed through the clear inner walls of the channels and the clear back of the holder; and filling the holder with loose items such that the loose items are between the clear front, the clear right side, the clear left side and the clear back.

14. The method of claim 13 wherein the clear inner walls of the channels are adhered to the back of the holder and are separated by a distance over which the outer surface of the clear back of the holder is exposed.

15. The method of claim 13 further comprising mounting a plurality of holders to the shelf by passing fasteners through holes in each holder and holes in the shelf such that each of the plurality of holders is within a quarter inch of at least one other holder.

16. The method of claim 15 further comprising removing a card from two channels of a holder without removing any holders from the shelf, wherein the holder that the card is removed from is within a quarter inch of neighboring holders on two opposing sides of the holder.

17. The method of claim 13 wherein mounting a holder comprises mounting the holder such that a front section of the holder extends upward from a front edge of the shelf.

* * * * *